US006821051B2

(12) United States Patent
Attar

(10) Patent No.: US 6,821,051 B2
(45) Date of Patent: Nov. 23, 2004

(54) ONE-PIECE STRUCTURAL BODY FOR REFLECTIVE PAVEMENT MARKER

(76) Inventor: Adil H. Attar, 550 Bucknell Ave., Claremont, CA (US) 91711

( * ) Notice: Subject to any disclaimer, the term of this patent is extended or adjusted under 35 U.S.C. 154(b) by 9 days.

(21) Appl. No.: 10/245,023

(22) Filed: Sep. 18, 2002

(65) Prior Publication Data

US 2003/0016997 A1 Jan. 23, 2003

Related U.S. Application Data

(63) Continuation-in-part of application No. 09/800,443, filed on Mar. 5, 2001, now abandoned, which is a continuation-in-part of application No. 09/419,741, filed on Oct. 16, 1999, now Pat. No. 6,267,530.

(51) Int. Cl.[7] ..... E01F 11/00; E01F 9/06
(52) U.S. Cl. ..... 404/16; 404/15
(58) Field of Search ..... 404/16, 15, 14

(56) References Cited

U.S. PATENT DOCUMENTS 3,409,344 A * 11/1968 Balint ..... 359/531
4,388,359 A * 6/1983 Ethen et al. ..... 428/143
5,425,596 A * 6/1995 Steere et al. ..... 404/14
5,667,335 A * 9/1997 Khieu et al. ..... 404/14
5,941,655 A * 8/1999 Jacobs et al. ..... 404/14
6,126,360 A * 10/2000 May et al. ..... 404/14
6,267,530 B1 * 7/2001 Attar ..... 404/16
6,551,014 B2 * 4/2003 Khieu et al. ..... 404/14

* cited by examiner

*Primary Examiner*—Thomas B. Will
*Assistant Examiner*—Raymond W Addie

(57) ABSTRACT

A reflective pavement marker can be fabricated utilizing a typically used housing (shell) reinforced by agglutination of a one-piece, monolithically formed, hollowed structural body. The hollowed structural body is having a sealed, textured base surface and an upper, two sides and two face surfaces defined by load carrying partition walls forming multiple hollow cavities. This type of hollowed structural body can effectively replace various structural fill systems or any other multi elements structural body used in fabricating a reflective pavement marker. The hollowed structural body is generally welded or agglutinated directly to the interior of a housing (shell), and to portion of the apexes of the cube corner reflective elements within said reflective faces of a housing. This type of hollow structural body can be formed to fit any single piece housing fabricated with integrally molded retro-reflective faces.

4 Claims, 3 Drawing Sheets

ONE-PIECE STRUCTURAL BODY FOR REFLECTIVE PAVEMENT MARKER

This application is a continuation-in-part of Ser. No. 09/419,741 filed Oct. 16, 1999 now U.S. Pat. No. 6,267,530 and is a continuation-in-part of Ser. No. 09/800,443 filed Mar. 5, 2001 now abandoned.

FIELD OF INVENTION

This invention relates to roadway markers that are used for traffic lane delineation, in particular, to markers with simplified, low cost structural body.

BACKGROUND OF THE INVENTION

Roadway markers are used on pavements along centerlines, edge lines, lane dividers, near fire hydrants or guardrail. Other roadway markers are used as temporary lane dividers during construction phases. The most commonly used retro-reflective roadway markers using a housing filled with structural polymeric material are based on Heenan U.S. Pat. No. 3,332,327, Balint U.S. Pat. No. 3,409,344, or Hedgewick U.S. Pat. No. 5,002,424.

Typically, these types of markers are produced in a process consisting of three to four steps: Firstly, injection molding of a thermoplastic housing (shell), integrally molded with one or two reflective faces.

Each inclined reflective face, integrally having multiple of cube corner reflective elements within the inside surfaces of the optically transparent housing (shell).

Secondly, either the reflective faces within a shell or the entire inside surface of the shell can be coated with a reflective metallic sealer by a process known as vacuum metalizing. This metallic sealer is needed to seal the cube corner reflective elements so they retain part of their retro-reflectivity prior to the next step of filling the shell with a thermosetting resinous material, such as epoxy or polyurethane to form a rigid structural body.

This resinous filler material encapsulates the metalized cube corner reflective elements and agglutinate to interior surfaces of said housing, thereby provide the marker the impact resistant structural body.

Finally, a layer of relatively course sand or glass beads are dispersed over the outer surface of the filler material prior to solidification of the filler material. Part of the sand particles will remain partially protruding above the planar surface of the marker base, thereby increasing the adhesive welding parameter of the base surface.

These types of markers worked well for six or seven months, however, due to poor abrasion and incompatibility of the shell material to the resinous filler material causes pealing of the reflective face or the shell, thereby losing retro-reflectivity. A major disadvantage of this type of structural body is that epoxy or urethane liquid fill systems are expensive, inconsistence in quality and environmentally unfriendly.

Another major development in the pavement marker art has been made; this was achieved by eliminating the use of the metalized sealer for the cube corner reflective elements.

U.S. Pat. No. 4,726,706 to Attar, which is incorporated herein by reference in its entirety, divide the inside surfaces of the reflective faces into reflective cells, each cell will have multiple cube corner reflective elements, the cells are isolated from each other by partition and load carrying walls. However, instead of metalizing the inside surfaces, all inside surfaces of the reflective faces has to be sealed by a thin sheet prior to filling the shell with resinous structural polymers.

Likewise PCT/US2001/0048847 A1 to Khieu discloses a shell housing either integrally made having multiple cube corner reflective elements within two inclined faces or a sheet of reflective elements adhered to said inclined faces. The entire inside surface with the cube corner reflective elements must be sealed with a thin sheet prior to filling the housing with resinous material.

U.S. Pat. No. 6,126,360 to May discloses pavement marker having unfilled shell (housing) and lower base plate with load carrying walls.

The housing (shell) is made of a composite material having two inclined faces. Each inclined face is integrally formed with recessed area (12*b*) and (12*c*). Each recessed area having multiple load-carrying wall (22) defining hollow cavity recesses (24).

A lens member (50) is welded to the load carrying walls (22) within the recessed areas (12*b*) and (12*c*) of the marker housing prior to welding the base plate (314).

The goal of this invention is to have a durable roadway marker with high reflectance, low cost and utilizing the presently used shell like housing that is monolithically formed including at least one inclined reflective face with multiple cube corner reflective elements and without the need to weld a lens sheeting to a sealed, recessed portion of a housing, or without the need to seal the reflective elements with a thin sheet prior to filling the housing. This invention also eliminates the need to fill the housing with resinous filler material.

SUMMARY OF THE INVENTION

This invention provides a novel process of forming one piece, hollowed structural body that can replace the potting process for a typical epoxy filled reflective pavement markers having one piece upper housing (shell). The present invention also eliminates the process of sealing the lens surfaces either within a secondary sealed, recessed regions of a housing or sealed with a thin sheet of plastic. This method provides a monolithically injection molded, one-piece, hollowed structural body with a sealed and textured base area that provides large welding parameter, thereby providing better adhesion to the pavement and higher resistance to flexural stresses. The one-piece hollowed structural body provides integrally formed load carrying walls that can be welded directly to a portion of the apexes of the cube corner reflective elements, while retaining the apexes of the remaining cube corner elements freely within air gaps inside the hollow cavities defined by said load carrying walls.

Alternatively, if a housing (shell) such as Attar's 706 is used, the inside raised partition walls defining the reflective cells within each reflective face can be used for agglutination onto said one-piece structural body which is fabricated to match Attar's 706 housing interior.

The primary objective of this invention is to provide a process of manufacturing one-piece structural body, thereby replacing the process of potting the housing with a resinous filler material and pre-sealing the lens surfaces.

Another objective of this invention is to provide a raised roadway marker made of high impact resistant material without the need to use composite material.

The surface of this reflective pavement marker can be abrasion resistant with high reflective index. The present invention further provides a method of making two-piece raised roadway marker of any desirable shape and configuration, such as, a marker with truncated body.

In accordance with still further aspects of this invention, the marker can be made for one or two way traffic usage.

Having an integrally built-in cube corner reflective elements provides durability and cost effectiveness.

DESCRIPTION OF THE PREFERRED EMBODIMENT

This application describes a one-piece hollowed structural body replacement for pavement markers of the art that require metallic sealing of the reflective surfaces and potting or filling typically, the shell like housing, with resinous polymeric filling material to achieve structural support. Metallization and contact of the potting compound with the metalized reflective surface reduce reflectance considerably.

This method of replacing the potted epoxy structural body of a pavement marker art, with a pre-molded hollowed structural body, eliminates previous arts needs to seal the protruding apexes of the cube corner reflective elements.

This invention also eliminates the need to metelize the reflective elements within the shell like housing prior to potting the structural body of the pavement marker of the previous Arts.

Figure 1:
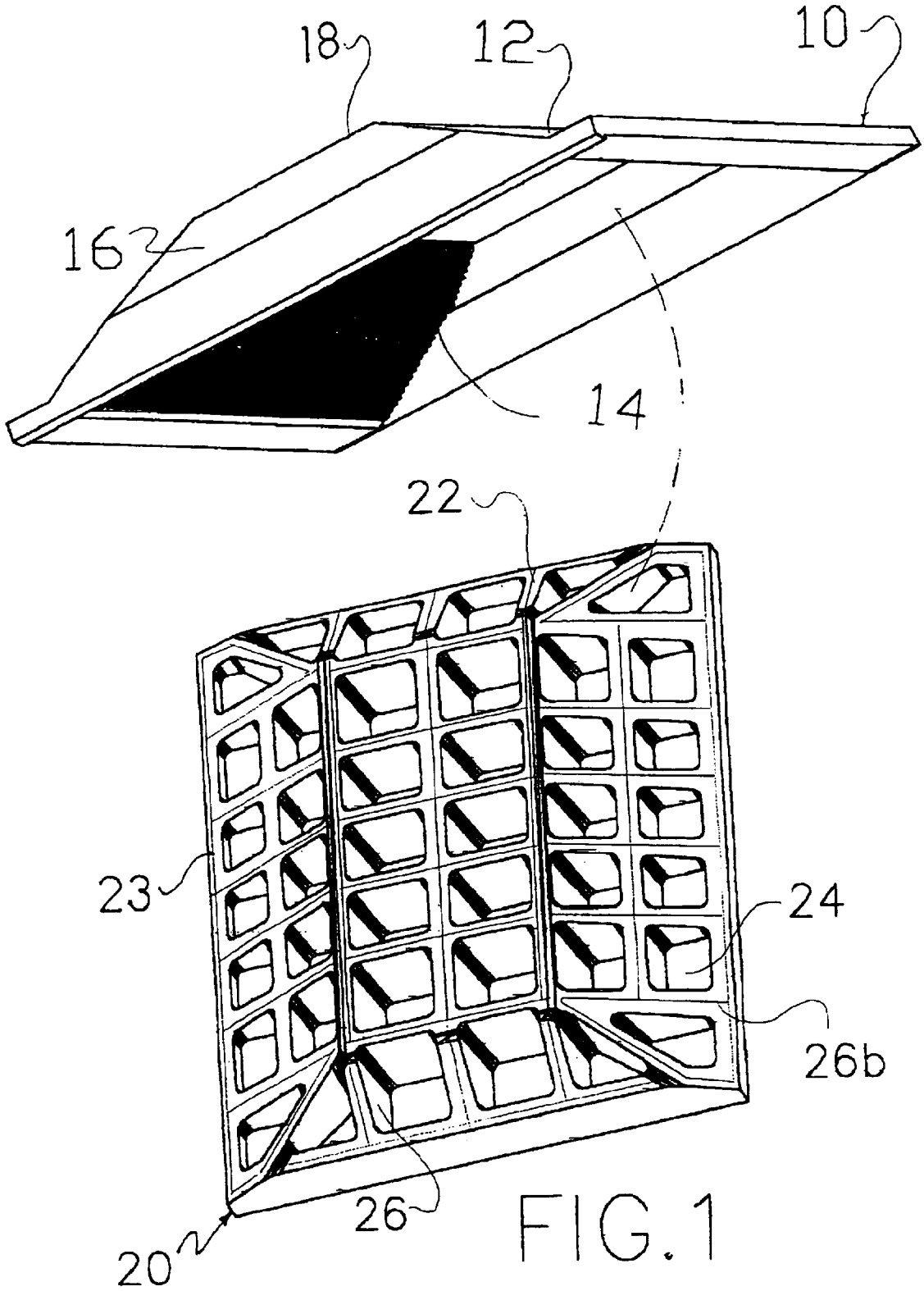
FIG. 1 is an isometric view showing a typical reflective pavement marker housing and the preferred monolithically formed one-piece hollowed structural body.
Figure 2:
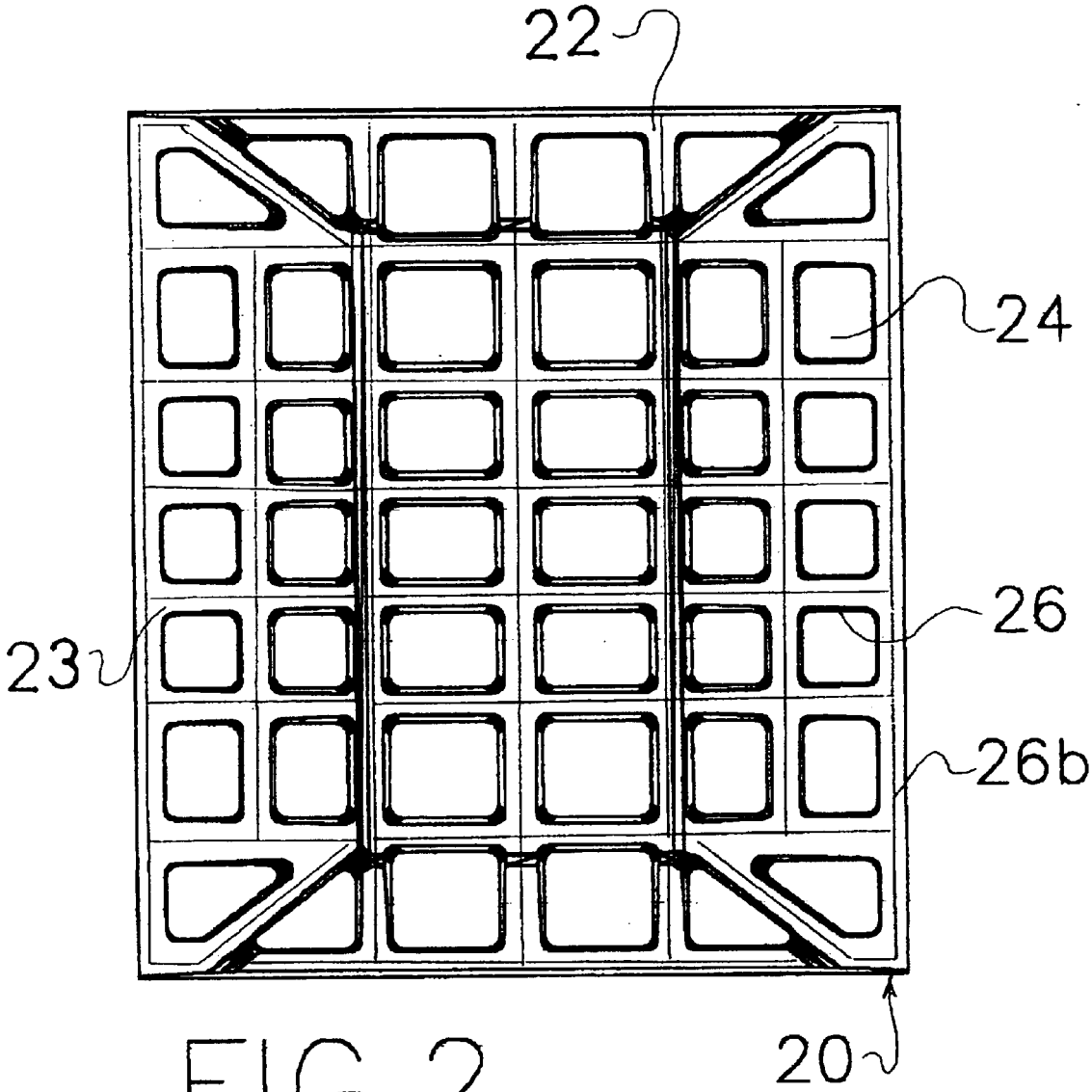
FIG. 2 is a plan view of one of the preferred one-piece hollowed structural body.
Figure 3:
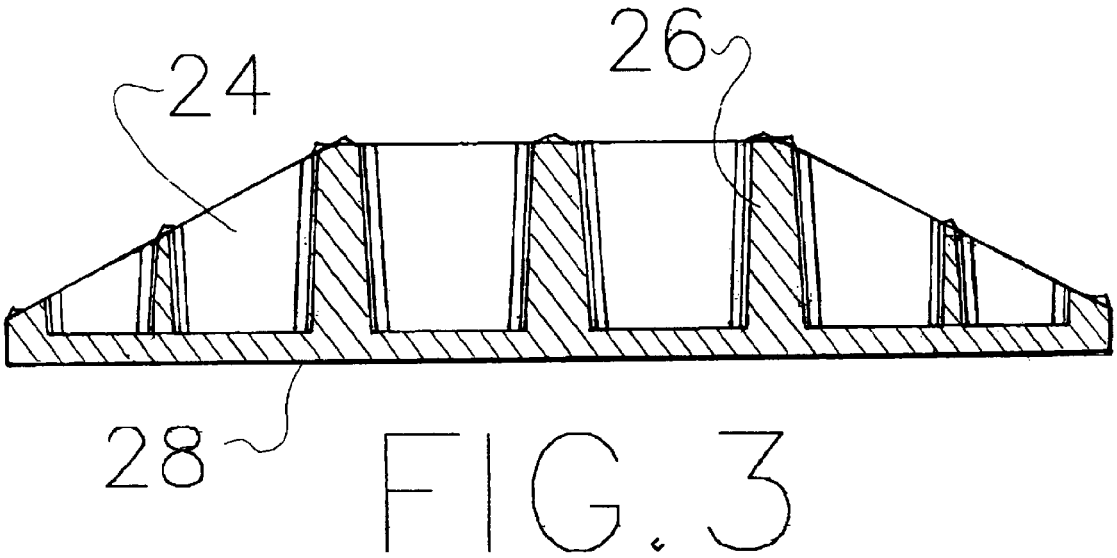
FIG. 3 is a cross section through line 3—3 of FIG. 2.

The scope of the invention is not limited to the structural body design shown in FIGS. 1, 2 and 3. It should be understood, that the scope of the invention herein also are applicable to alternative structural body designs not disclosed.

Minor design variation of the hollowed structural body of this invention can be made so as to still fall within the scope of the claims and can be used to fit other types of pavement marker arts with potted shell like housing, such as for example (but not limited to), that described in Heenan U.S. Pat. No. 3,332,327, Balint U.S. Pat. No. 3,409,344 or Hidgewick U.S. Pat. No. 5,002,424.

Referring now to the drawings, FIG. 1 shows a perspective view of one example of a pavement marker incorporating the present invention. The pavement marker in FIG. 1 includes a shell like housing 10 incorporating a monolithically formed one-piece hollowed structural body 20. The structural body 20 is generally solid, formed as a one-piece member with a sealed base surface. FIGS. 2 and 3 show the top and cross-sectional views of the integrally formed structural body 20 having two regions, a sealed planar base region 28 with textured and slightly grooved surface for maximizing the pavement marker's adhesion to the roadway surface and upper regions comprising of a top 21, two inclined or arcuate sides 22 and two inclined faces 23. The entire upper regions of structural body 20 incorporate multiple of hollowed recesses or cavities 24 defining load carrying partition walls 26, each with wedge shaped top end 26*b*.

The upper hollowed surfaces of the structural body 20 are typically formed to conform to the interior surface dimensions of any, specifically desired, shell like housing 10.

All pavement markers of this type have front and back planar inclined surfaces for retro-reflection, two inclined or arcuate sides and a top surface. Various exterior shapes and sizes of this type of reflective pavement markers are commonly used. Generally, the most commonly used pavement marker exterior dimensions are either 2 by 4, 2.5 by 4, 3 by 4 or 4 by 4-inches.

The monolithically formed hollowed structural body 20 is directly agglutinated to portions of the interior apexes of the cube corner reflective elements 14 of the shell like housing 10, thereby leaving the majority of the cube corner reflective elements freely functioning within correspondingly formed cell like hollow cavities 24.

When sonic welding process is used, vibration fuses the wedge shaped top portions 26*b* of the load carrying partition walls 26 to few protruding apexes of cube corner reflective elements 14 as well as to other designated interior surfaces of the shell like housing 10.

Presently, there are several manufacturing groups that utilize processes based on Heenan's U.S. Pat. No. 3,332,327, Balent U.S. Pat. No. 3,409,344, Hedgewick U.S. Pat. No. 5,002,424 or Attar's U.S. Pat. No. 4,726,706.

All such manufacturing groups can easily eliminate at least two major steps, the potting of the shell like housing and metalizing the cube corner reflective prisms, which are presently disadvantage processes used for assembling a reflective pavement marker.

The only thing required for eliminating the use of liquefied polymeric filling process is designing the upper regions of the one-piece hollowed structural body 20 to fit exactly within the interior contours of an existing shell like housing 10.

The present method is environmentally friendly; provide maximum marker base surface area for adhesion to the roadway and it is cost effective due to the low cost of forming the hollowed structural body 10.

FIG. 1 shows a typical shell like housing 10 with a top planar surface 18, two inclined sides 16 and a reflective face 12 having interior surface with multiple cube corner reflective elements 14.

FIGS. 1, 2 and 3 show an example of a monolithically formed, hollowed structural body 20, which is typically fabricated by injection molding process.

Structural body 20 is normally designed to correspond exactly to the interior surfaces of a desired shell like housing 10.

The scope of the invention is not limited to this one example of a shell like housing or the structural body herewith.

The wedge shaped top surfaces 26*b* are slightly textured and contoured to correspond exactly to the interior surface of the housing 10 to which it is agglutinated.

The wedge shaped top surfaces 26*b* of load-carrying partition walls 26, that are directly beneath the inclined reflective faces 12, defining cell like air gaps. These cells like air gaps, each will retain multiple cube corner reflective elements 14.

The wedge shaped top surfaces 26*b* of load carrying partition walls 26 minimize the number of cube corner reflective elements 14 that would be fused to partition walls 26 surfaces, thereby allowing maximum portions of such cube corner reflective elements 14 to function freely within the cell like air gaps of the hollow cavities 24.

Various agglutination processes can be used to weld the monolithically formed structural body 20 to a shell like housing 10. Preferably sonic welding method can be used. Alternatively, a compatible, transparent adhesive can be applied.

Another example of a shell like housing 10 that can be used as an alternative example is the shell used in Attar's U.S. Pat. No. 4,726,706, incorporated herein in its entirety. The interior surface of the reflective face 12 can be used with or without any raised partition walls defining multiple reflective cells.

The shell like housing 10, shown in FIG. 1 has the interior of reflective face 12 without raised partition walls, it has the entire interior reflective surface 12 integrally formed with either micro or the standard size cube corner reflective elements 14.

Thermoplastic polymers such as acrylic or polycarbonate can have both, the desired optical transparency for the reflective faces 12 as well as the structural and tear resistance strength. The shell like housing 10 of Balint et al U.S. Pat. No. 3,409,344 art has been frequently used by some manufacturers of pavement markers. This type of shell like housing 10 requires to sonically agglutinate the optical reflective faces 12, which are commonly made of transparent acrylic or polycarbonate, to an ABS or polycarbonate body segment of shell like housing 10, thereby allowing the use of opaque pigmentation for the body segment only of the shell like housing 10. The commonly used cube corner reflective elements 14 for this type of shell like housings 10 are known as the standard types; as per the originally recommended prisms of Heenan U.S. Pat. No. 3,332,327, Balint et al U.S. Pat. No. 3,409,344 and also used for Attar U.S. Pat. No. 4,726,706.

However, it is recommended that finer or small micro cube corner prism be used to optimize both the retro-reflectivity as well as limiting the loss of cube corner reflective prisms that fall within the welding parameter.

The preferred polymeric material to make such hollowed structural body 20 is ABS thermoplastic. However, even a recycled ABS, acrylic, polycarbonate, reinforce or non-reinforced engineered plastic can be used, provided it would be compatible for agglutination to the material of the corresponding shell like housing 10, to which it will be welded.

Typically, the tooling needed for fabrication of this type of hollowed structural body 20 is a simple injection-molding mold. No additional slides or other moving parts are necessary.

The method of agglutinating the one-piece hollowed body 20 to the housing 10 can be achieved either by applying a thin thermosetting adhesive material to the upper surfaces of the hollowed structural body 20, then firmly inserting the housing (shell) onto the adhesive surfaces.

Alternatively, agglutination of the one-piece hollowed structural body 20 to the interior of housing 10 can be achieved by sonically welding the two parts.

Other advantages of this direct agglutination of the cube corner reflective elements 14 to the top surfaces 26*b* of load carrying partition walls 26 is that even the cube corner elements that would be agglutinated to said surfaces would retain air gaps entrapped behind portion of the remaining three surfaces of each cube corner element, thereby partial retro-reflectivity can be attained from these agglutinated cube corner elements.

It is understood that various changes or modification can be made within the scope of the appended claims. All such modifications fall within the true scope and spirit of this invention.

What is claimed is:

1. A reflective pavement marker comprising:

an upper shell-like housing and a monolithically formed one-piece hollowed structural body, said structural body agglutinated to said shell-like housing, said shell-like housing comprising a top surface, two inclined side walls and two inclined planar reflective faces, at least one of said planar reflective faces integrally having inner surface including plurality of cube corner reflective elements, said shell-like housing is made from a polymeric, thermoplastic selected from a group of polycarbonate or acrylic, said hollowed structural body comprising an integrally sealed planar base surface including texture outer surface for agglutination to a roadway surface, said outer surface of said sealed base can be divided into shallow recesses, said structural body comprising an upper hollowed regions, said upper hollowed regions comprising a top surface, two sides and two inclined front and back faces corresponding to the interior contours of said shell-like housing, said upper hollowed regions of said structural body are defined by partition and load carrying walls, said partition and load carrying walls having tapered sides and a wedge shaped top surfaces, said wedge shaped top surfaces correspond to the interior contours of said shell-like housing, said hollowed structural body can be made of a compatible polymeric material, said polymeric material can be of recycled or virgin material selected from either ABS, polycarbonate, acrylic, said polymeric material can have additive filler materials for strength or pigmentation, said shell-like housing is welded to said structural body utilizing sonic welding process or direct agglutination methods.

2. The reflective pavement marker of claim 1, wherein said structural body may be agglutinated or sonic welded onto interior surfaces of said shell-like housing, said interior surfaces of reflective faces providing portions of the protruding apexes of said cube corner reflective elements for agglutination onto a correspondingly wedge shaped top portions of said load carrying walls within said one-piece hollowed structural body, whereby retaining the remaining cube corner reflective elements protruding freely within said hollow cavities of said structural body.

3. The reflective pavement marker of claim 1, wherein said shell-like housing can have the interiors of said two reflective faces divided into reflective cells, said reflective cells each having plurality of cube corner reflective elements, said reflective cells are separated from each others by partition walls, said partition walls are spaced to correspond to the size and shapes of partition and load carrying walls within said structural body.

4. A method of fabricating the reflective pavement marker having a shell like housing agglutinated to wedge shaped top surfaces of partition and load carrying walls defining a monolithically formed one piece hollowed structural body, said method comprising the steps:

a) injection molding the shell-like housing, said housing including at least one transparent reflect face, said housing having any desired exterior geometric size or shape; said injection molding utilizing either a one or two steps molding process, b) monolithically injection molding a hollowed structural body integrally including a textured and sealed planar base surface and upper hollowed regions defined by wedged shaped top surfaces of partition and load carrying walls, c) welding said one piece hollowed structural body to the interior surface of the shell like housing such that portion of the apexes of the cube corner reflective elements as well as portion of the inner surfaces of said shell like housing adhere to the wedge shaped top surfaces of partition and load carrying walls within said one piece structural body;

d) either the entire outside surface of the shell like housing or the reflective faces can be coated with abrasion resistance hard carbon or aluminum oxide film.

* * * * *